US006222425B1

(12) United States Patent
Okada et al.

(10) Patent No.: US 6,222,425 B1
(45) Date of Patent: Apr. 24, 2001

(54) NONRECIPROCAL CIRCUIT DEVICE WITH A DIELECTRIC FILM BETWEEN THE MAGNET AND SUBSTRATE

(75) Inventors: Takekazu Okada, Ishikawa-ken; Toshihiro Makino, Matto; Takashi Kawanami, Ishikawa-ken; Takashi Hasegawa, Kanazawa, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/281,496

(22) Filed: Mar. 30, 1999

(30) Foreign Application Priority Data

Mar. 30, 1998 (JP) ..... 10-083583
Feb. 12, 1999 (JP) ..... 11-034174

(51) Int. Cl.[7] ..... H01P 1/383
(52) U.S. Cl. ..... 333/1.1; 333/24.2
(58) Field of Search ..... 333/1.1, 24.2

(56) References Cited

U.S. PATENT DOCUMENTS 3,922,620 11/1975 Deutsch ..... 333/1.1
5,068,629 * 11/1991 Nishikawa et al. ..... 333/1.1
5,153,537 10/1992 Desmarest ..... 333/1.1
5,923,224 * 7/1999 Makino et al. ..... 333/1.1
5,945,887 * 8/1999 Makino et al. ..... 333/1.1

FOREIGN PATENT DOCUMENTS 0779673 6/1997 (EP) .

OTHER PUBLICATIONS

European Search Report dated Jun. 25, 1999.

* cited by examiner

*Primary Examiner*—Justin P. Bettendorf
(74) *Attorney, Agent, or Firm*—Ostrolenk, Faber, Gerb & Soffen, LLP

(57) ABSTRACT

A nonreciprocal circuit device having a circuit element on a dielectric substrate providing at least part of a low-pass filter, the nonreciprocal circuit device having less interference and irregular operation caused by spurious radiation, and in addition, with reduced insertion loss. A lumped constant isolator (an example of a nonreciprocal circuit device) includes a magnet provided for applying a DC magnetic field to a magnetic assembly, which in turn has multiple intersecting central electrodes provided adjacent to a ferrite body. A dielectric substrate is disposed in between the permanent magnet and the magnetic assembly. An inductor forming part of a π-type low-pass filter is provided as an example of a circuit element on the dielectric substrate, a dielectric layer or film being disposed between the dielectric substrate and the magnet.

16 Claims, 12 Drawing Sheets

NONRECIPROCAL CIRCUIT DEVICE WITH A DIELECTRIC FILM BETWEEN THE MAGNET AND SUBSTRATE

BACKGROUND OF THE INVENTION

1. Field of the Invention

The present invention relates to a nonreciprocal circuit device for use in a microwave band such as, for instance, an isolator or a circulator.

2. Description of the Related Art

Generally, a nonreciprocal circuit device, such as a lumped constant isolator or a circulator, has low attenuation of signals in the forward direction and high attenuation of signals in the reverse direction, and is used in a transmission circuit of a communications unit such as, for instance, a mobile telephone.

However, linear distortion in an amplifier integrated into a communications unit causes radiation (spurious emissions, especially at two and three times the fundamental frequency). Since this radiation can cause interference and irregular operation of a power amplifier, it must be kept below a fixed level. Radiation is sometimes prevented by using an amplifier with excellent linearity, or by using an extra filter to attenuate radiated waves.

However, an amplifier with excellent linearity is expensive, and using an extra filter increases the number and cost of components, and in addition, increases the overall size of the communications equipment. For these reasons, these measures cannot easily be used in mobile telephones and the like, where there is a strong demand for smaller and less expensive devices.

On the other hand, a lumped constant isolator functions as a bandpass filter in the forward direction, and consequently it has large attenuation in the forward direction in frequency bands distant from the pass band. It may be envisaged that radiation can be attenuated by utilizing these characteristics to block spurious emissions outside the pass band. However, since conventional isolators were not originally designed to obtain attenuation outside the pass band, their capability for this purpose is limited.

Accordingly, the present applicants devised an experimental isolator (not yet publicly known) which contains a circuit element comprising a low-pass filter. As shown in FIG. 12, this isolator includes an inductor L1 which is a constituent element of a low-pass filter. This inductor L1 is patterned on a dielectric substrate 18 which is provided between a magnetic assembly 4 and a magnet 6, and connected between an input port and a matching capacitor Co'.

Consequently, as shown in the equivalent circuit diagrams of FIG. 13 and FIG. 14, a π-type low-pass filter, comprising the connection of C1-L1-C2, is connected to the input port. Here, since C1 is provided by a part of the capacitance of the matching capacitor Co' of the isolator, it does not need to be provided separately. C2 is formed by externally appending a capacitance to the isolator.

According to the above mentioned isolator containing a low-pass filter, attenuation outside the pass band can be increased, and interference and irregular operation caused by radiation can be prevented. The low-pass filter has a simple constitution and is inexpensive, making an expensive amplifier and an extra filter unnecessary, and enables the device to be made small-scale at low cost.

However, when the above low-pass filter is provided on a dielectric substrate, the magnet is in contact with the dielectric substrate, and consequently there is a concern that the high-frequency material characteristics of the magnet, particularly the tangent δ or Dissipation Factor (Dissipation Factor=tangent δ×100[%]), will have an adverse effect on the insertion loss of the isolator.

In general, commercially available mass-produced magnets were not developed for high-frequency components, and they are consequently liable to have a considerable dissipation factor (loss tangent). Therefore, it can be expected that the insertion loss of the isolator will increase when a circuit element on the dielectric substrate is in contact with the magnet. A further problem is that the magnet has a high dielectric constant, making it difficult to form inductance.

SUMMARY OF THE INVENTION

The present invention has been realized in consideration of these problems, and is able to provide a nonreciprocal circuit device which is capable of reducing the insertion loss of an isolator when a circuit element is provided on a dielectric substrate.

The nonreciprocal circuit device of the present invention comprises a magnetic assembly comprising a plurality of central conductors arranged so as to intersect adjacent to a ferrite body, a dielectric substrate disposed between a magnet and said magnetic assembly, said magnet applying a dc magnetic field to said magnetic assembly; wherein a circuit element is provided by patterning on said dielectric substrate, and a dielectric film or layer is disposed at least between said circuit element on said dielectric substrate and said magnet.

Alternatively, the dielectric film may be affixed to the magnet, or to the dielectric substrate.

In other embodiments of the present invention, the circuit element is provided by patterning on a laminated dielectric substrate, and at least one dielectric layer of said laminated substrate is disposed between at least said circuit element and said magnet.

In an alternative arrangement, a circuit element may be provided by patterning on said dielectric substrate, and a dielectric film may cover at least one part of the surface of said circuit element.

Preferably, the circuit element may comprise all or part of an inductor; a π-type low-pass filter; an LC series bandpass filter comprising an inductor and a capacitor; a phase-shift circuit comprising a micro-stripline; a phase-shift circuit comprising a stripline; a directional coupler; a capacitance coupler comprising a capacitor; or a band-elimination filter. Each of these circuit elements is known to the art. Each is formed by patterning as described herein.

Other features and advantages of the present invention will become apparent from the following description of embodiments of the invention which refers to the accompanying drawings.

DESCRIPTION OF PREFERRED EMBODIMENTS OF THE INVENTION

Preferred embodiments of the present invention will be described with reference to the accompanying drawings.

Figure 1:
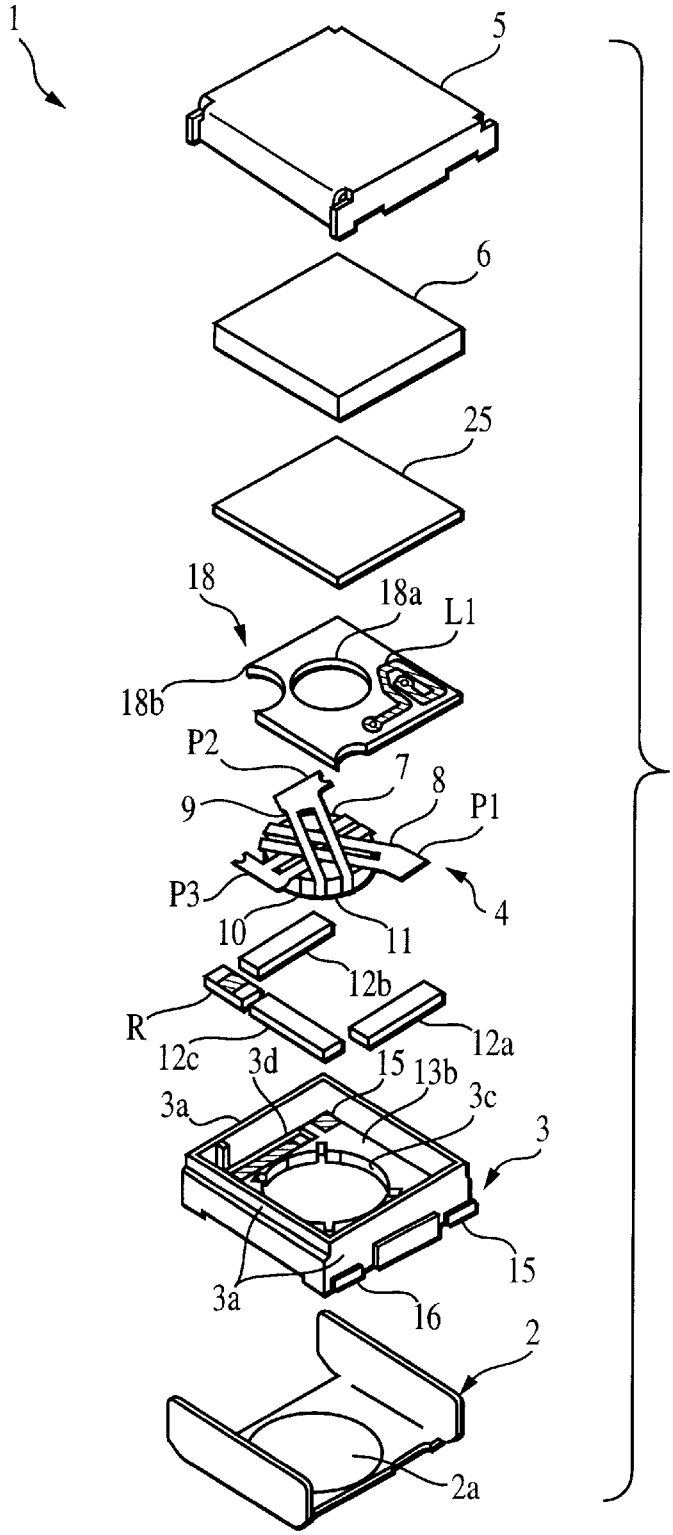
FIG. 1 is an exploded perspective view to explain a lumped constant type isolator according to a first embodiment of the present invention.
Figure 2A:
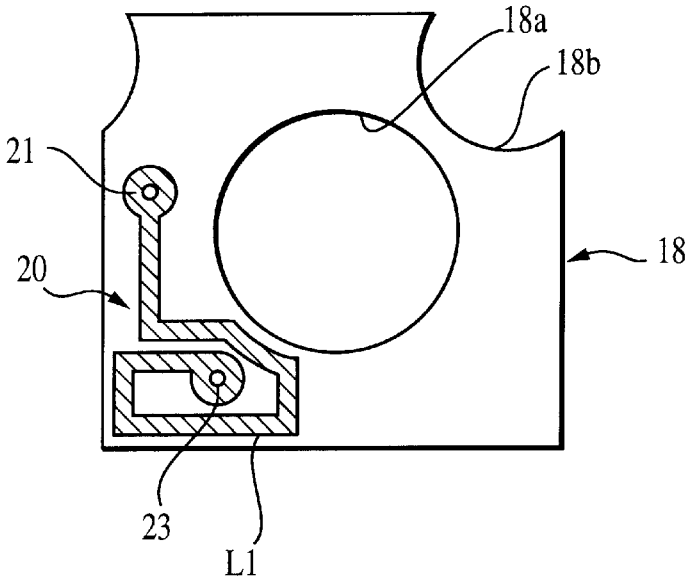
FIGS. 2A and 2B are diagrams showing an inductor on the dielectric substrate of the isolator shown in FIG. 1.
Figure 2B:
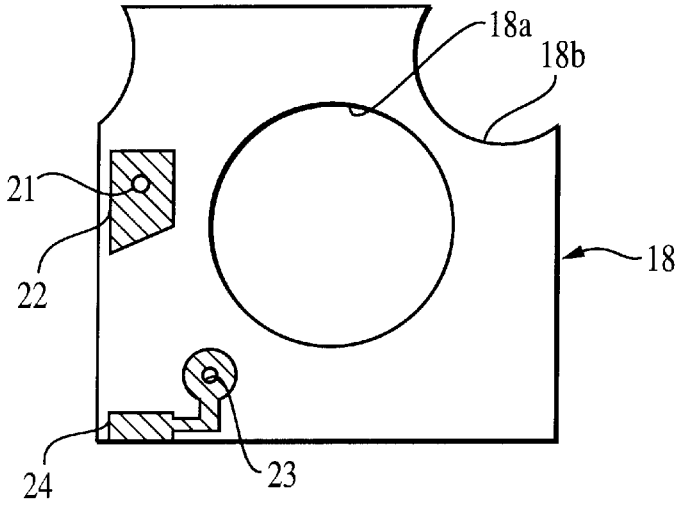

FIGS. 1, 2A and 2B are diagrams to explain a lumped constant type isolator according to a first embodiment of the present invention, FIG. 1 being an exploded perspective view of the isolator, FIG. 2A, a plan view of an inductor provided on a dielectric substrate, and FIG. 2B, a perspective plan view of an electrode provided on the back face of the dielectric substrate.

In FIG. 1, a lumped constant isolator 1 comprises a terminal block 3 provided on the bottom surface 2*a* of a case 2 made of magnetic metal, a magnetic assembly 4 provided on the terminal block 3, a box-like cap 5 made of the same magnetic metal as the case 2, a rectangular permanent magnet 6 affixed to the inner surface of the cap 5, forming a magnetic circuit, wherein the permanent magnet 6 applies a dc magnetic field to the magnetic assembly 4.

The magnetic assembly 4 comprises three central conductors 8, 9 and 10, which intersect at angles of 120 degrees and are provided on the upper surface of a circular disk-like ferrite 7, with an interposed insulating sheet (not shown in the diagram), and a ground 11 connected to the central conductors 8–10 abutting on the lower surface of the ferrite 7.

The terminal block 3 is made of electrically insulating resin, and comprises rectangular frame-like side walls 3*a* integrally provided with a bottom wall 3*b*, a through hole 3*c* being provided in the bottom wall 3*b*. Recessed portions 3*d* are formed in the bottom wall 3*b* surrounding the through hole 3*c*. The recessed portions 3*d* accommodate single plate matching capacitors 12*a*–12*c* and a single plate terminal resistor R.

The magnetic assembly 4 is inserted through the through hole 3*c*, so that the ground 11 of the magnetic assembly 4 connects to the bottom surface 2*a* of the case 2.

Input/output terminals 15 for surface mounting and a ground terminal 16 are provided on the outer surfaces of the left and right side walls 3*a* of the terminal block 3, and the input/output terminals 15 lead out at corners of the upper surface of the bottom wall 3*b*. Furthermore, the ground terminal 16 leads out at each of the recessed portions 3*d*, and is connected to one end of the lower surface electrode of each of the capacitors 12*a*–12*c* and the terminal resistor R. The terminals 15 and 16 are each partially insert-molded in the terminal block 3.

Input/output ports P1–P3 of the central conductors 8–10 are connected to the electrodes on the upper surfaces of the capacitors 12*a*–12*c*. The tip of the port P2 is connected to the output terminal 15, and the tip of the port P3 is connected to the terminal resistor R.

A rectangular plate-like dielectric substrate 18 is provided on the upper surface of the magnetic assembly 4. When the cap 5 and the permanent magnet 6 are attached to the case 2, the dielectric substrate 18 electrically and mechanically holds the magnetic assembly 4 and the terminal block 3 to the case 2, and holds the ports P1–P3 of the central conductors 8–10 to the capacitors 12*a*–12*c*. Furthermore, a hole 18*a* is provided in the center of the dielectric substrate 18 to correspond to the magnetic assembly 4, and a notch 18*b* is provided in a corner of the dielectric substrate 18 to correspond to the terminal resistor R.

An inductor L1 is provided by patterning on the upper surface of the dielectric substrate 18, to form a circuit element 20 comprised in a π-type low-pass filter. A first end of the inductor L1 connects via a through hole electrode 21 to a connection electrode 22 on the lower surface of the dielectric substrate 18, and a second end of the inductor L1 similarly connects via a through hole electrode 23 to an input electrode 24 on the lower surface. The first end of the inductor L1 is connected by the connection electrode 22 to the port P1 of the central conductor 8, and the second end is connected by the input electrode 24 to the input terminal 15.

Further, a dielectric film 25 is provided between the dielectric substrate 18 and the permanent magnet 6, the dielectric film 25 being sandwiched between the permanent magnet 6 and the dielectric substrate 18. The dielectric film 25 is rectangular, so as to completely cover the lower surface of the permanent magnet 6, and has low dielectric constant and low dissipation factor.

Next, the effects and advantages of the present invention will be described.

According to the lumped constant isolator 1 of the present invention, an inductor L1 is provided by patterning on a dielectric substrate 18, and the inductor L1, a capacitor 12*a* and an external capacitor comprise a π-type low-pass filter, whereby attenuation outside the pass band can be increased and interference and irregular operation caused by unnecessary radiation can be prevented. Consequently, it is possible to realize a low-pass filter of simple structure which is inexpensive, making the expensive amplifier and extra filter described above unnecessary, and contributing to downsizing and cost reduction.

In the above-described experimental device, there was a concern that insertion loss of the isolator would increase when the permanent magnet 6 contacted the inductor L1 on the dielectric substrate 18. By contrast, in the present embodiment, a dielectric film 25 having low dielectric constant and low loss tangent (dissipation factor) is sandwiched between the dielectric substrate 18 and the permanent magnet 6, enabling the inductor L1 to be separated from the permanent magnet 6, which has a high dielectric constant and a high loss tangent. The inductance thereby increases and the insertion loss decreases. Thus, the Q of the inductor can be improved and, as a result, the insertion loss of the isolator can be reduced.

The present embodiment has described a rectangular dielectric film 25 which completely covers the lower surface of the permanent magnet 6. However, the advantages of the present invention are achieved merely by the separation of the inductor from the permanent magnet, having high dielectric constant and high loss tangent, by inserting a dielectric layer of low dielectric constant and low loss tangent therebetween. Therefore, there are no particular limitations on the shape and size of the inserted dielectric.

For instance, since air is also a dielectric of low dielectric constant and low tangent, a layer of air can be provided between the magnet and the inductor by providing a hole in the portion of the dielectric film which contacts the inductor L1, achieving the same effects as the embodiment already described. Furthermore, when using a dielectric film with a hole provided therein, it is possible to use a dielectric of high dielectric constant and tangent.

Polyimide, Teflon, epoxy, glass epoxy or the like is used as the material for the dielectric film 25. Furthermore, other non-conductive insulating materials other than those mentioned above can be used as the dielectric film 25.

Figure 3:
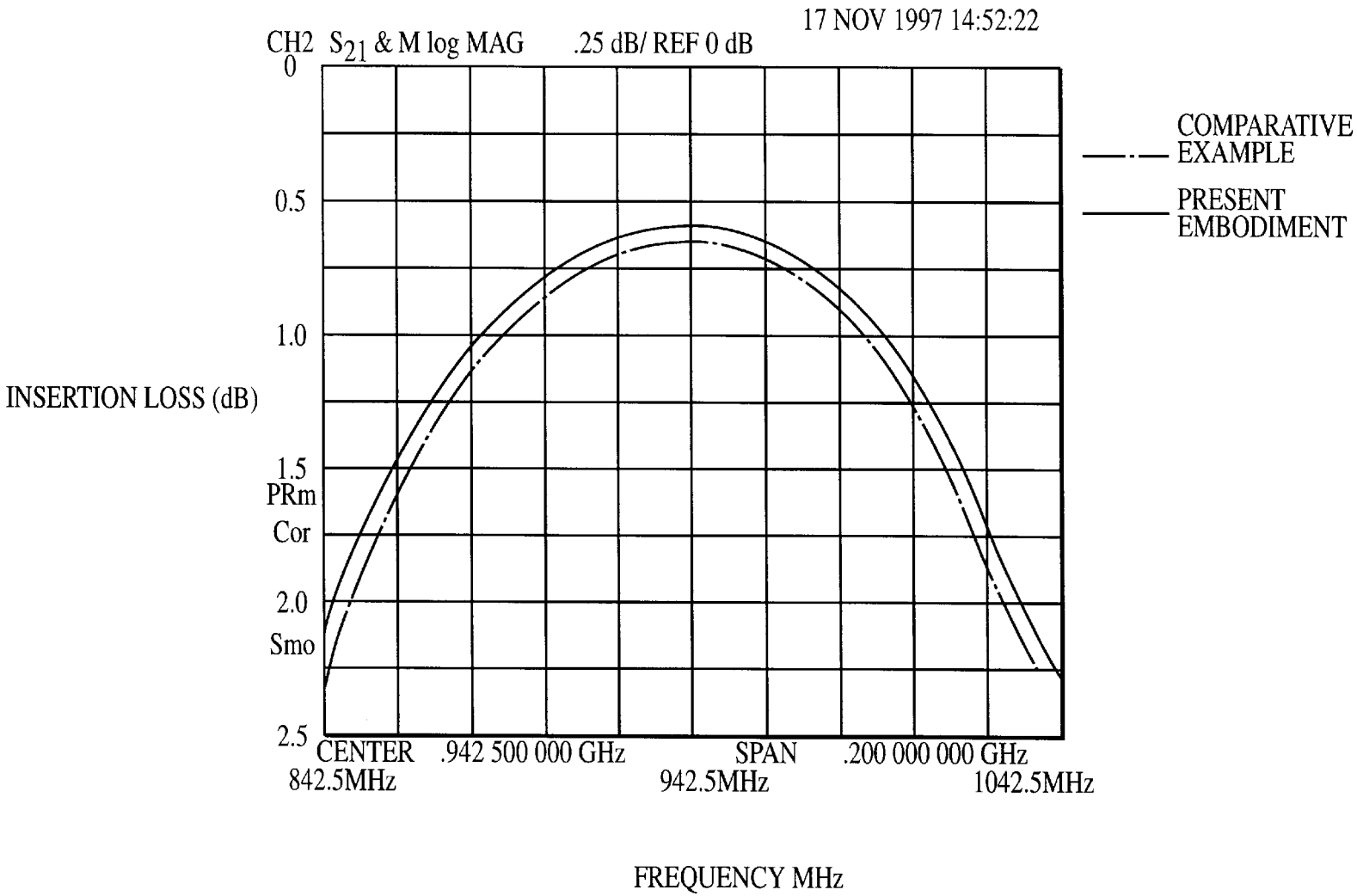
FIG. 3 is a characteristics diagram showing effects of the first embodiment.

FIG. 3 is a characteristics diagram showing measurements of insertion loss taken to confirm the effects of the above lumped constant isolator. The permanent magnet used in this experimentation has relative dielectric constant of 25, and tangent of $1\times10^{-2}$, and the dielectric film has relative dielectric constant of 3.5, tangent of $2\times10^{-3}$, and thickness of 50 $\mu$m. For comparison, similar measurements were taken for an isolator with no dielectric film (in FIG. 3, the alternate long and short dash line represents the comparative example, and the solid line represents the present embodiment). As is clearly shown in FIG. 3, insertion loss can be improved by roughly 0.05 dB when the dielectric film is used.

The above embodiment describes a case where the inductor L1 constituting a low-pass filter is provided on a dielectric substrate 18, but the circuit element of the present invention is not restricted to this, and it is acceptable to use, for instance, an LC series bandpass filter, a micro-stripline phaseshift circuit, a stripline phase-shift circuit, a directional coupler, a capacitance coupler, or a band-elimination filter, known as a BEF, trap filter or notch filter, or the like, and these achieve substantially the same effects as in the above embodiment.

Figure 4A:
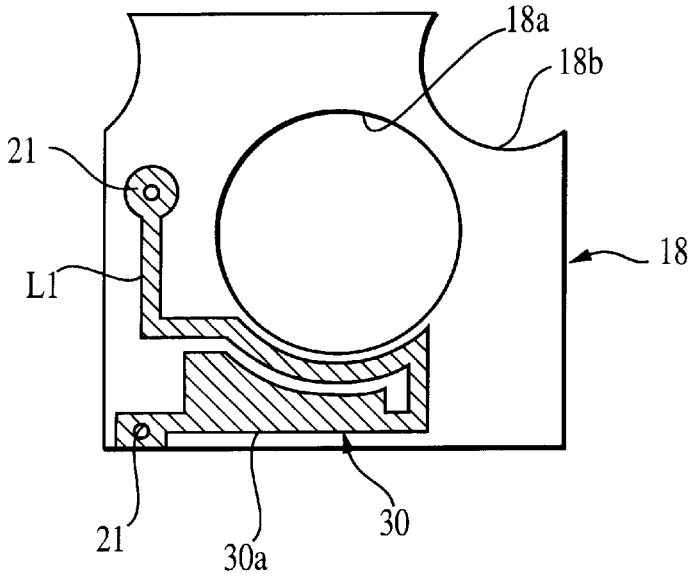
FIGS. 4A and 4B are diagrams showing a dielectric substrate according to another embodiment of the present invention.
Figure 4B:
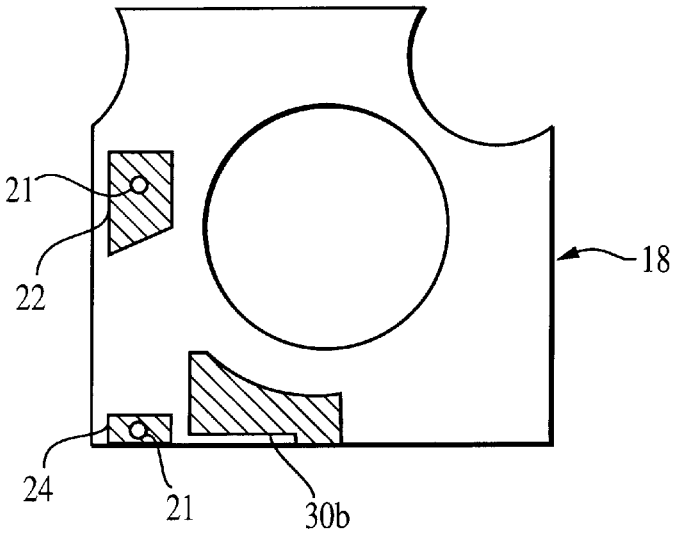
Figure 5:
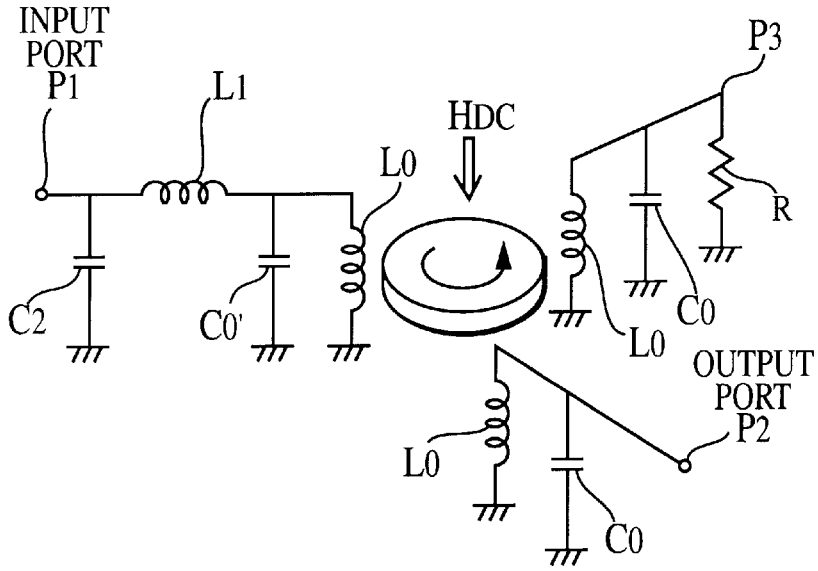
FIG. 5 is an equivalent circuit diagram of the isolator of the embodiment shown in FIGS. 4A and 4B.
Figure 6:
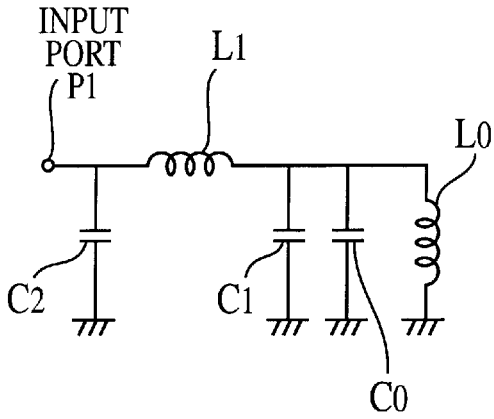
FIG. 6 is an equivalent circuit diagram of part of the isolator of the embodiment shown in FIGS. 4A and 4B.
Figure 13:
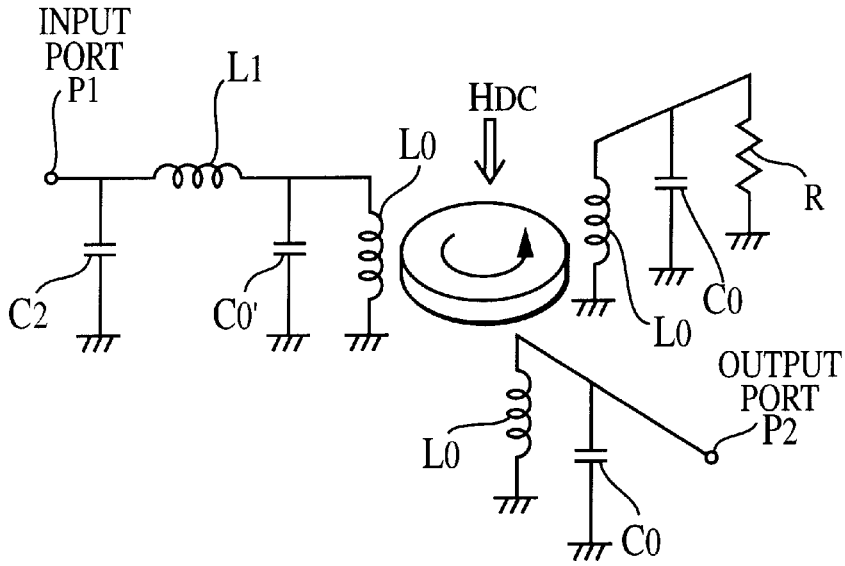
FIG. 13 is an equivalent circuit diagram of the isolator shown in FIG. 12.
Figure 14:
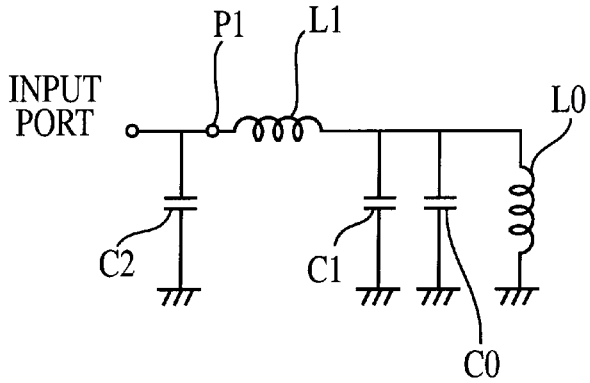
FIG. 14 is an equivalent circuit diagram of part of the isolator shown in FIG. 12.

FIGS. 4A to 6 are diagrams explaining other embodiments of the present invention described above, FIG. 4A being a plan view of a capacitor and an inductor provided on a dielectric substrate, FIG. 4B being a perspective plan view of an electrode provided on the rear surface of the dielectric substrate, and FIG. 5 and FIG. 6 being their respective equivalent circuits. In these diagrams, identical and corresponding parts to those in FIG. 2, FIG. 13 and FIG. 14 are designated by identical reference characters.

The isolator of the present embodiment comprises an inductor L1 and a capacitor 30, provided by patterning on the upper surface of a dielectric substrate 18 to form a circuit element, comprising a low-pass filter. The port P1 of a central conductor 8 is connected via a through hole electrode 21 and a connection electrode 22 to a first end of the inductor L1.

A first capacitor electrode 30*a* is connected to a second end of the inductor L1 and connected to an input electrode 24 via the through hole electrode 21. On the rear surface of the dielectric substrate 18, a second capacitor electrode 30*b* is provided at the portion facing the first capacitor electrode 30*a*, and this second capacitor electrode 30*b* is connected to the case 2 as a ground.

Consequently, as shown in the equivalent circuit diagrams of FIG. 5 and FIG. 6, a $\pi$-type low-pass filter is formed at the input port. Here, C1 is provided by a portion of the matching capacitance Co' of the isolator, and therefore does not need to be separately provided, and C2 is the capacitor 30 provided on the dielectric substrate 18.

In this embodiment, a dielectric film is clasped between the dielectric substrate and the permanent magnet, whereby interference and irregular operation caused by undesirable radiation can be prevented, while reducing the insertion loss of the isolator, consequently obtaining the same effects as the embodiments described earlier.

Figure 7:
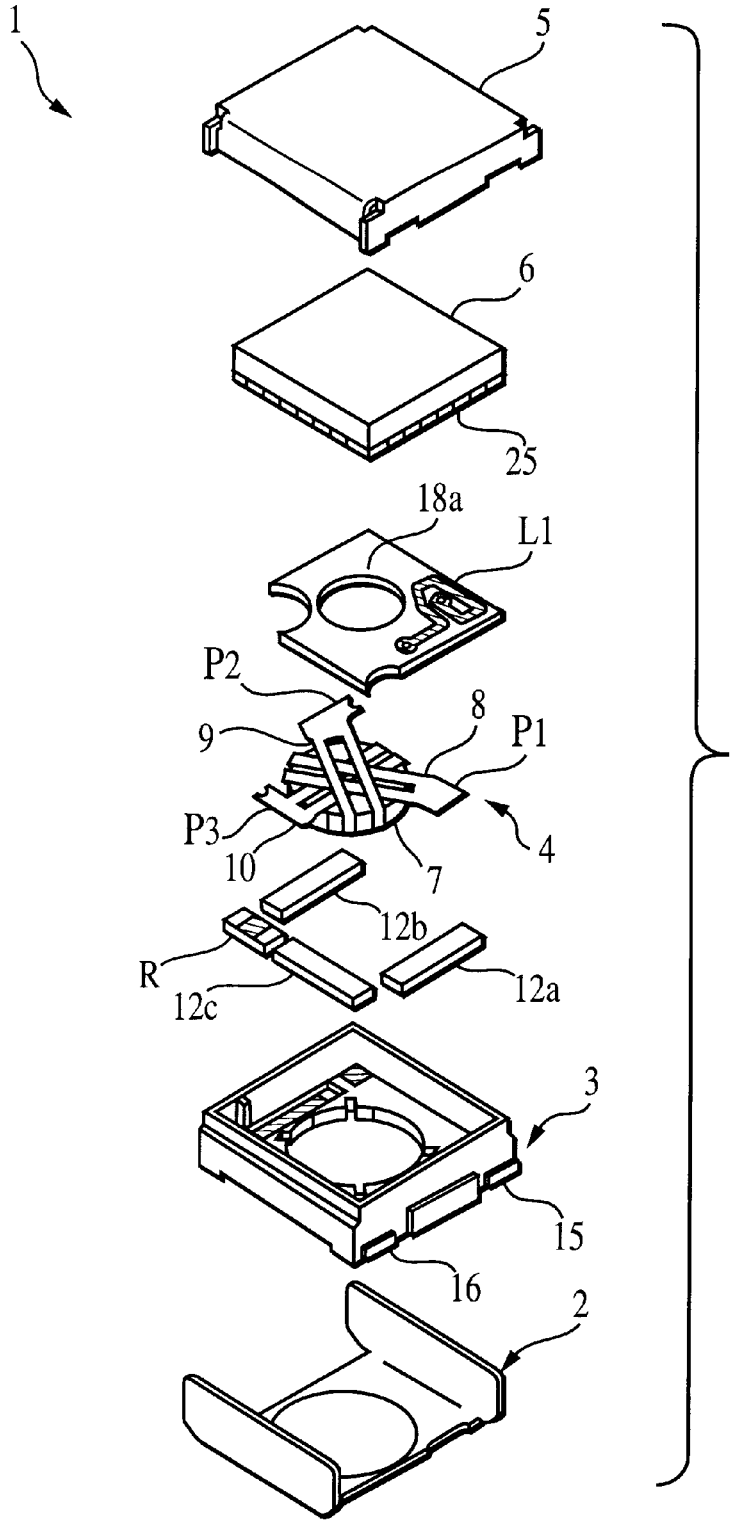
FIG. 7 is an exploded perspective view of a lumped constant type isolator according to a third embodiment of the present invention.

FIG. 7 is an exploded perspective view of a lumped constant isolator according to a third embodiment of the present invention, wherein members identical and corresponding to those of FIG. 1 are designated by identical reference numerals.

The lumped constant isolator 1 of the present embodiment is an example in which a dielectric film 25 having low dielectric constant and low loss tangent is clasped between the dielectric substrate 18 and the permanent magnet 6, the dielectric film 25 being affixed to the lower surface of the permanent magnet 6, so as to overlie at least the inductor L1 on the dielectric substrate 18.

In the present embodiment, the dielectric film 25 is provided between the dielectric substrate 18 and the permanent magnet 6, and in addition, it is affixed to the permanent magnet 6, whereby the insertion loss of the isolator is reduced as in the previous embodiment, and in addition, the dielectric film 25 can easily be incorporated when the isolator is assembled, improving workability.

Figure 8:
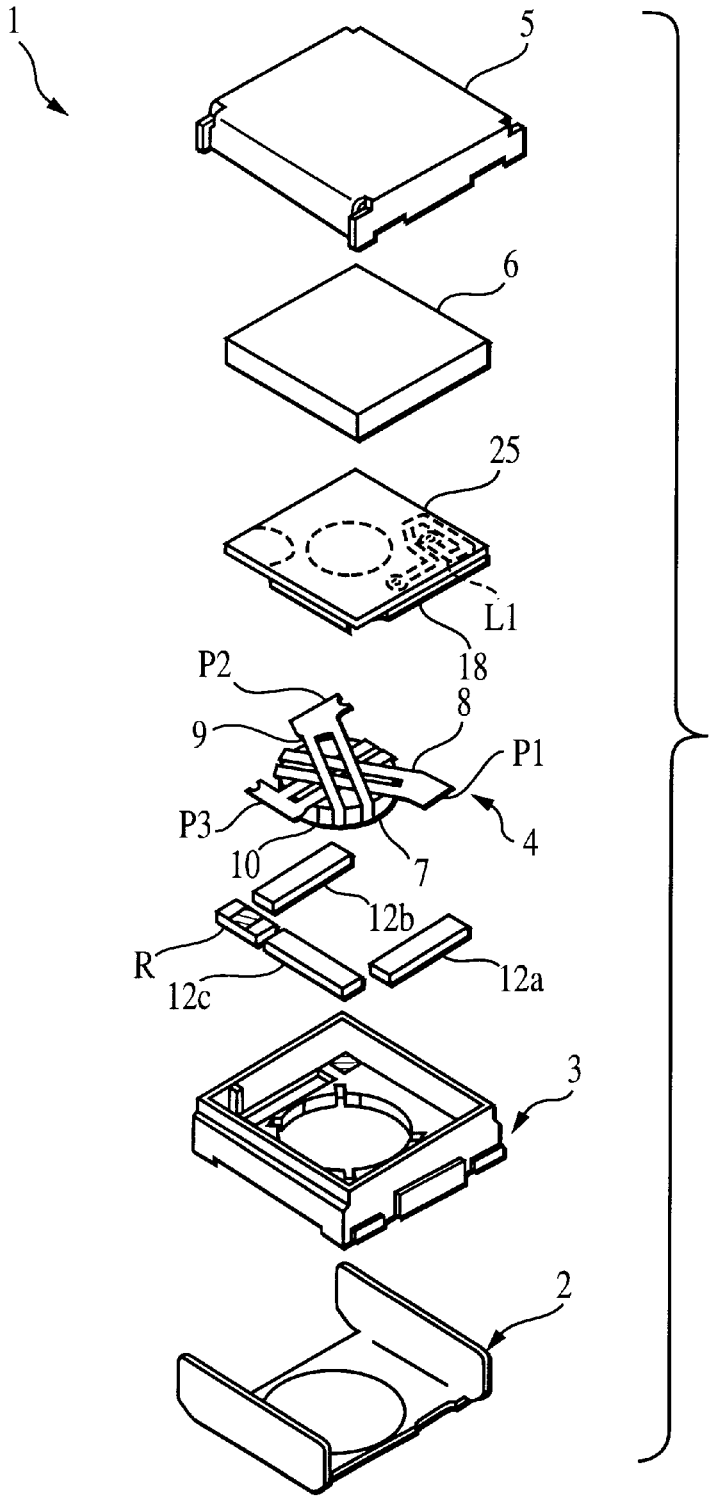
FIG. 8 is an exploded perspective view of a lumped constant type isolator according to a fourth embodiment of the present invention.

FIG. 8 is an exploded perspective view of a fourth embodiment of the present invention, wherein members identical and corresponding to those of FIG. 1 are designated by identical reference numerals.

The lumped constant isolator 1 of the present invention is an example in which a dielectric film 25 having low dielectric constant and low loss tangent is clasped between the dielectric substrate 18 and the permanent magnet 6, the dielectric film 25 being affixed to the entire upper surface of the dielectric substrate 18, or at least a sufficient part of the upper surface to overlie the inductor L1.

In the present embodiment, the dielectric film 25 is provided between the dielectric substrate 18 and the permanent magnet 6, and in addition, it is affixed to the dielectric substrate 18, whereby the insertion loss of the isolator is reduced as in the previous embodiments, and in addition, the dielectric film 25 can easily be incorporated when the isolator is assembled, improving workability.

Figure 9:
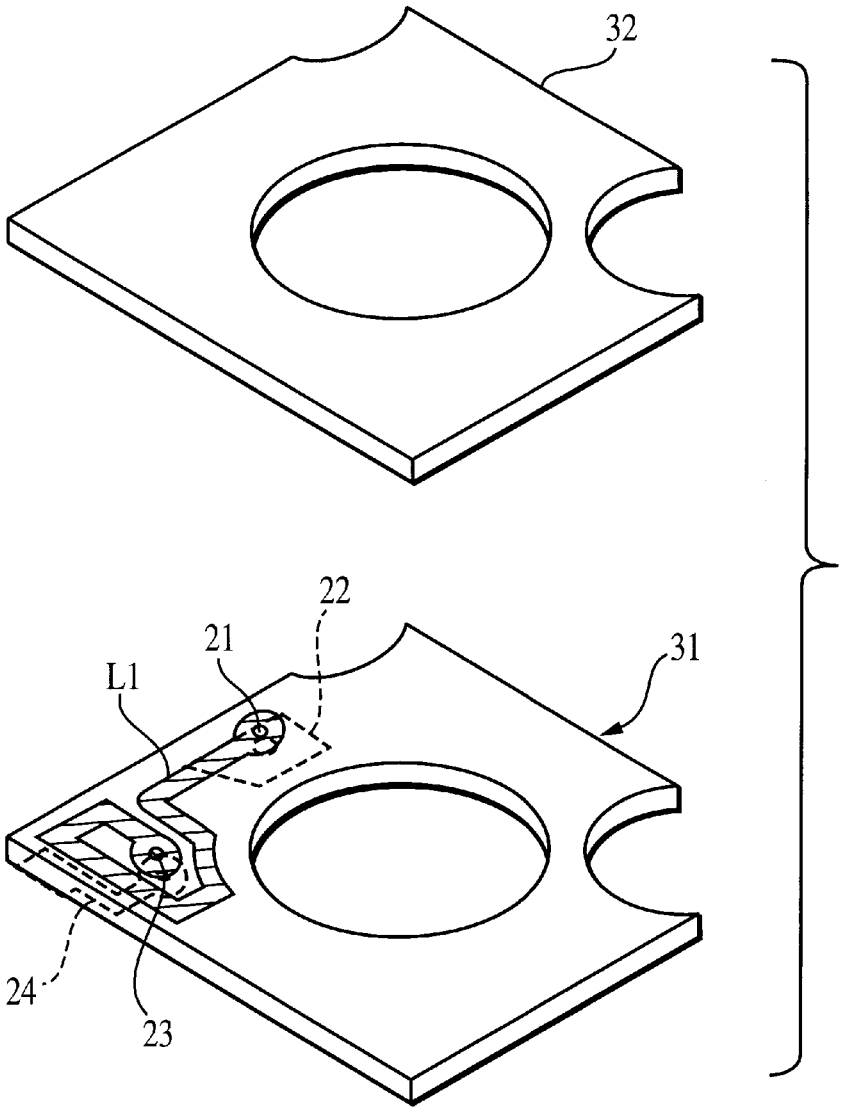
FIG. 9 is an exploded perspective view of a dielectric substrate according to another embodiment of the present invention.

FIG. 9 is diagram explaining a dielectric substrate according to another embodiment of the present invention, wherein members identical and corresponding to those of FIG. 2 are designated by identical reference numerals.

In the embodiment, an inductor L1 is provided, as a circuit element comprised in a low-pass filter, on a first dielectric substrate 31, and a single-layer second dielectric substrate 32 is provided between the upper surface of the first dielectric substrate 31 and the permanent magnet 6.

According to the present embodiment, a second dielectric substrate 32 is laminated on a first dielectric substrate 31, which the inductor L1 is provided on, and therefore the insertion loss of the isolator can be reduced, achieving the same effect as the embodiment described above. Furthermore, the first and second dielectric substrates 31 and 32 can be laminated together, reducing the number of components to less than when a separate dielectric film is used, as mentioned above, thereby further lowering costs.

Figure 10:
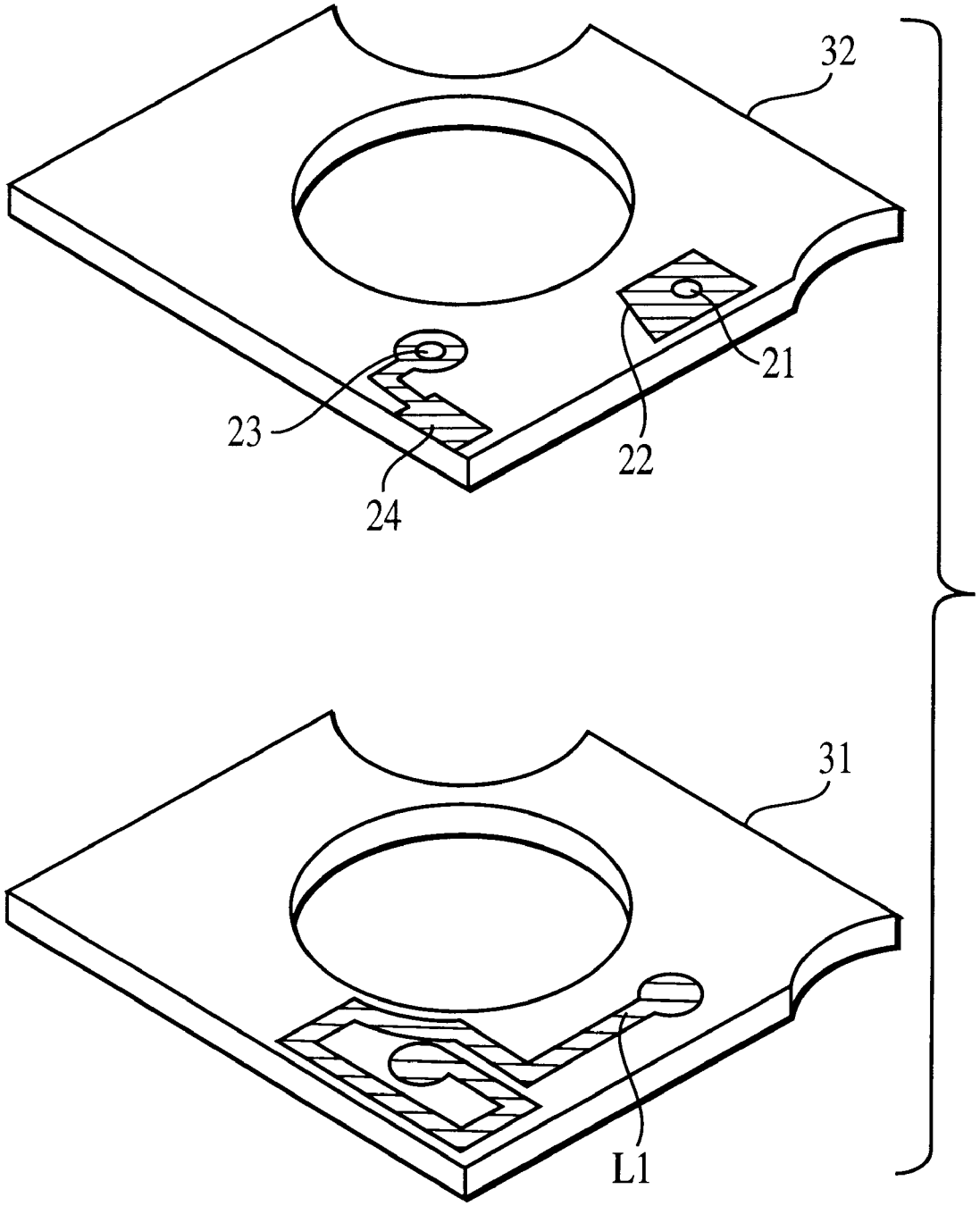
FIG. 10 is an exploded perspective view of a dielectric substrate according to another embodiment of the present invention.

FIG. 10 is a diagram explaining a dielectric substrate according to another embodiment of the present invention, wherein members identical and corresponding to those of FIG. 9 are designated by identical reference numerals.

The present embodiment is an example in which an inductor L1 is provided by patterning on the upper surface of a first dielectric substrate 31, and a connection electrode 22 and an input electrode 24, which are connected to the inductor L1, are provided by patterning on the upper surface of a second dielectric substrate 32.

In the present embodiment, since the inductor L1, the connection electrode 22 and the input electrode 24 are respectively provided on the upper surfaces of the first and second dielectric substrates 31 and 32, manufacture is easier than when electrode patterns are provided on both surfaces of a single substrate, enabling costs to be lowered further, and making it possible to provide an inexpensive isolator with low loss.

Figure 11A:
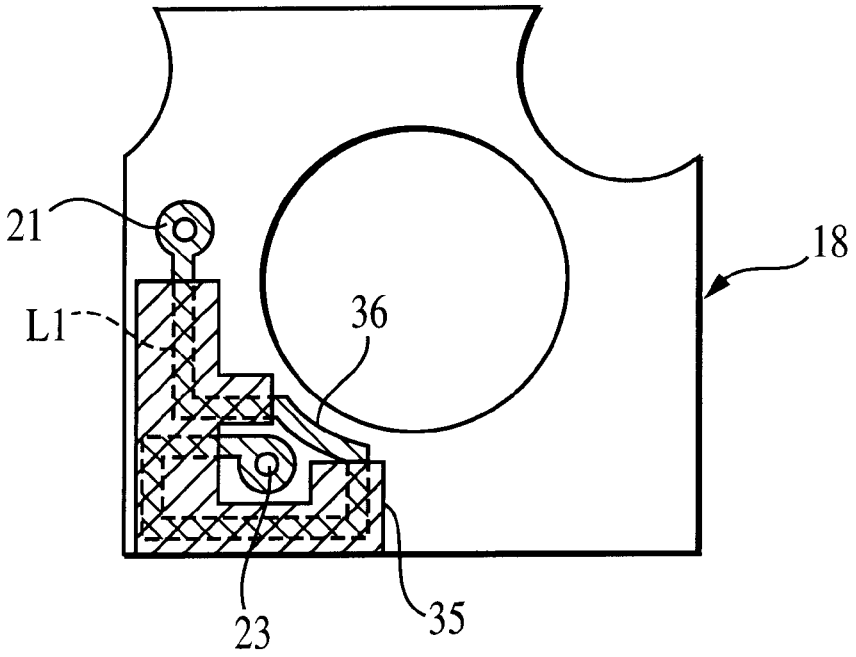
FIGS. 11A and 11B are diagrams showing a dielectric substrate according to another embodiment of the present invention.
Figure 11B:
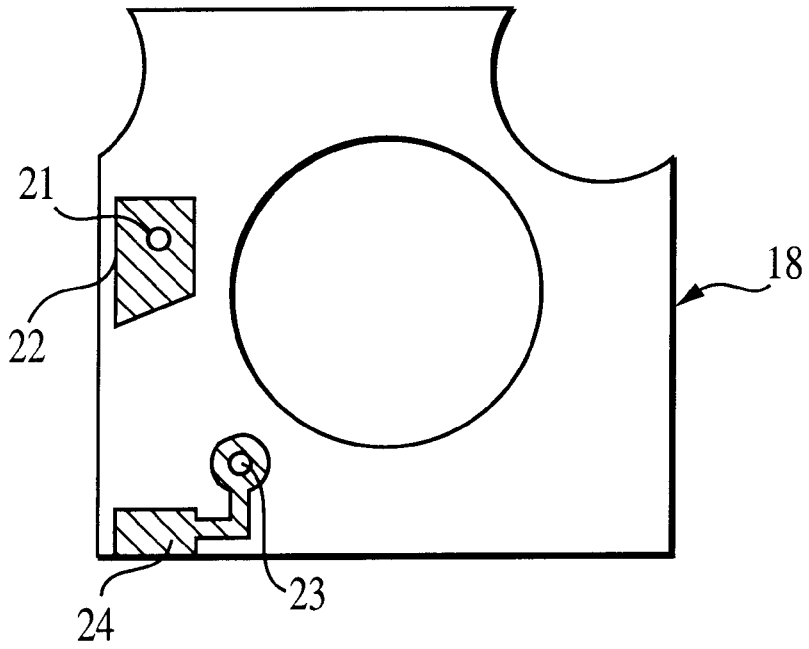
Figure 12:
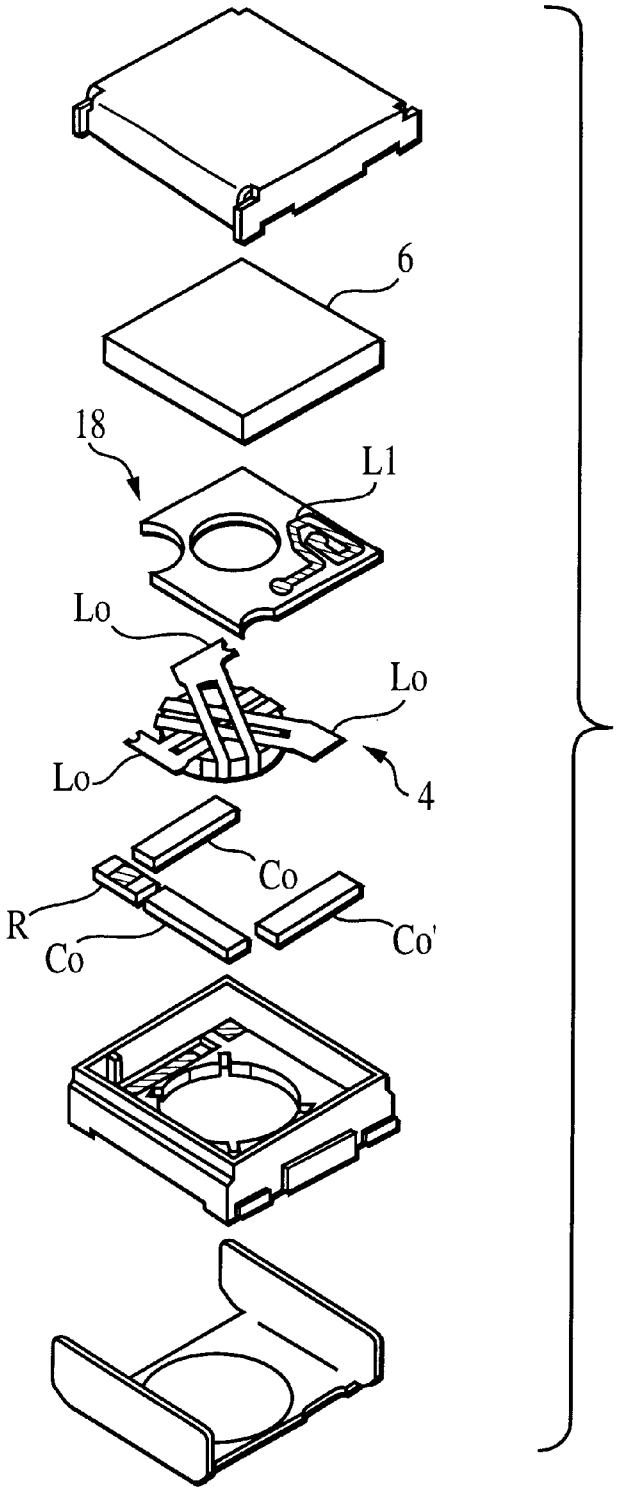
FIG. 12 is an exploded perspective view of an experimental isolator to explain the background of the present invention.

FIG. 11 is a diagram explaining a dielectric substrate according to another embodiment of the present invention, wherein members identical and corresponding to those of FIG. 2 are designated by identical reference numerals.

In the present embodiment, the inductor L1 on the upper surface of dielectric substrate 18 is covered with a thick dielectric film 35, provided using a method such as printing. This dielectric film 35 completely covers the inductor L1 with the exception of the central portion 36 of the line, which forms a layer of air between the dielectric film 35 and the magnet.

In the present embodiment, a dielectric film 35 of low dielectric constant and low tangent is applied over the inductor L1 on the dielectric substrate 18, enabling insertion loss of the isolator to be reduced, and achieving the same effects as the above embodiment. Furthermore, since the dielectric film 35 is applied onto the dielectric substrate 18, an increased number of components, which would lead to higher costs, can be avoided, and the device can be made inexpensive.

Furthermore, since the central portion 36 of the inductor L1 is covered by a dielectric layer comprising air, the same effect is achieved as when the dielectric film 35 is applied over. Alternatively, the dielectric film may be applied to the entire inductor L1 without leaving the central portion 36 exposed.

Each of the above embodiments described an example using a lumped constant isolator, but the present invention can, of course, be applied to a circulator.

As has been described above, in the nonreciprocal circuit device, a circuit element is provided by patterning on a dielectric substrate, and a dielectric film or material is sandwiched between the circuit element formed on the dielectric substrate and a magnet, and consequently, the magnet having a high dielectric constant and a high tangent can be kept separate from the circuit element, reducing the insertion loss of the isolator.

Furthermore, it is possible to realize an inexpensive low-pass filter having a simple constitution, whereby interference and irregular operation caused by undesirable radiation can be avoided, and the device can be made small-scale at low cost.

According to the present invention, the dielectric film or material may be affixed to the magnet, or to the dielectric substrate, whereby the insertion loss of the isolator is reduced as above, and in addition, the dielectric film can be more easily incorporated when assembling the isolator, having the advantage of improving workability.

Another embodiment of the invention provides a laminated substrate, there being provided an extra layer between the circuit element on the dielectric substrate and the magnet, whereby the insertion loss of the isolator is reduced as above, and in addition, an increased number of components, which would lead to higher costs, can be avoided, enabling the embodiment to be provided inexpensively.

According to another embodiment, a dielectric film covers at least part of the surface of the circuit element on the dielectric substrate, whereby the insertion loss of the isolator is reduced as above, and in addition, an increased number of components, which would lead to higher costs, can be avoided, enabling the invention to be provided inexpensively.

According to the present invention, an inductor, a π-type low-pass filter, an LC series bandpass filter, a micro-stripline phase-shift circuit, a stripline phase-shift circuit, a directional coupler, a capacitance coupler and a band-elimination filter, for example, may be the circuit element, and in each case the circuit can be made inexpensive, enabling the device to be made small-scale and at lower cost.

Although the present invention has been described in relation to particular embodiments thereof, many other variations and modifications and other uses will become apparent to those skilled in the art. Therefore, the present invention is not limited by the specific disclosure herein.

What is claimed is:

1. A nonreciprocal circuit device comprising:

a magnetic assembly comprising a plurality of central conductors arranged so as to intersect at an intersection point, while being insulated from each other, and a ferrite body disposed at said intersection point;

a magnet disposed for applying a dc magnetic field to said magnetic assembly;

a dielectric substrate disposed between said magnet and said magnetic assembly;

a circuit element comprising a conductor pattern on said dielectric substrate; and a dielectric film disposed between said magnet and said circuit element of said dielectric substrate.

2. The nonreciprocal circuit device according to claim 1, wherein said dielectric film has a lower dielectric constant and a lower dissipation factor than those of said magnet.

3. The nonreciprocal circuit device according to claim 1, wherein said dielectric film is disposed between said entire circuit element and said magnet.

4. The nonreciprocal circuit device according to claim 1, wherein said dielectric film is disposed between a part of said circuit element and said magnet.

5. A nonreciprocal circuit device according to claim 1, wherein said circuit element is an inductor.

6. The nonreciprocal circuit device according to claim 1, wherein said dielectric film is affixed to said magnet.

7. The nonreciprocal circuit device according to claim 1, wherein said dielectric film is affixed to said dielectric substrate.

8. The nonreciprocal circuit device according to claim 1, wherein said circuit element comprises at least part of a π-type low-pass filter, an LC series bandpass filter, or a band-elimination filter.

9. A nonreciprocal circuit device according to claim 8, wherein said circuit element is an inductor.

10. A nonreciprocal circuit device according to claim 1, wherein said circuit element comprises an inductor, said inductor being connected between one of said central conductors and an input/output terminal of said nonreciprocal circuit device;

further comprising a matching capacitor connected between said one of said central conductors and a ground terminal of said nonreciprocal circuit device so as to form an L-type low-pass filter with said inductor; whereby said nonreciprocal circuit device can be combined wiht an external capacitor connected between said input/output terminal and ground to form a π-type low-pass filter.

11. The nonreciprocal circuit device according to claim 10, further comprising an external capacitor connected between said input/output terminal and ground, whereby said matching capacitor, said inductor and said external capacitor form a π-type low-pass filter.

12. The nonreciprocal circuit device according to claim 1, wherein said circuit elements comprises an inductor and a capacitor, said inductor being connected between one of said central conductors and an input/output terminal of said nonreciprocal circuit device, said capacitor being connected between said input/output terminal and a ground terminal of said nonreciprocal circuit device;

further comprising a matching capacitor connected between said one of said central conductors and said ground terminal;

whereby said capacitor, said inductor and said matching capacitor form a πtype low-pass filter.

13. A nonreciprocal circuit device according to claim 10, wherein said circuit element is an inductor.

14. The nonreciprocal circuit device according to claim 13, wherein said ciruit element comprises at least part of a π-type low-pass filter, an LC series bandpass filter, or a band-elemination filter.

15. A non-reciprocal ciruit device according to claim 14, wherein said circuit element is an inductor.

16. A non-reciprocal ciruit device according to claim 13, wherein said circuit elements is an inductor.

* * * * *